United States Patent [19]

Shimada

[11] 4,433,236

[45] Feb. 21, 1984

[54] AUTOMATIC BRIGHTNESS CONTROL AND WARNING CIRCUIT FOR IMAGE INTENSIFIER TUBE

[75] Inventor: Mitsuhiro Shimada, Hamamatsu, Japan

[73] Assignee: Hamamatsu Photonics Kabushiki Kaisha, Hamamatsu, Japan

[21] Appl. No.: 330,810

[22] Filed: Dec. 15, 1981

[51] Int. Cl.[3] ..... H01J 3/14

[52] U.S. Cl. ..... 250/213 VT

[58] Field of Search ..... 250/213 VT, 207, 214 AG; 315/10; 313/523, 103, 104, 103 CM, 105, 105 CM; 340/42

[56] References Cited

U.S. PATENT DOCUMENTS 3,739,178 6/1973 Chow ..... 250/214 AG 4,166,213 8/1979 Hoover ..... 250/213 VT

*Primary Examiner*—David C. Nelms

*Assistant Examiner*—J. Jon Brophy

*Attorney, Agent, or Firm*—Spencer & Frank

[57] ABSTRACT

In an automatic brightness control feedback loop for controlling the bias voltage of a microchannel plate of an image intensifier tube, there are provided a gas discharge tube and a photoconductor which is photoelectrically coupled with the gas discharge tube. The brightness of the gas discharge tube is controlled depending on the phosphor screen current. An ordinary automatic brightness control and also the blinking when the incident light is excessive can be made by having the bias voltage of the microchannel plate depend on the resistance of the photoconductor.

6 Claims, 12 Drawing Figures

AUTOMATIC BRIGHTNESS CONTROL AND WARNING CIRCUIT FOR IMAGE INTENSIFIER TUBE

The present invention relates to a microchannel plate voltage control circuit for an image intensifier tube, and more particularly to a microchannel plate voltage control circuit for an image intensifier tube wherein a current flowing on a phosphor screen of the image intensifier tube is detected and its brightness is automatically controlled. When an incident light which enters into a photocathode is excessive, this is warned to an operator of the device by generating a blinking on the phosphor screen.

The image intensifier tube using the microchannel plate has heretofore been widely utilized for watching an object in the dark or trifle emission of light from a substance. A fundamental structure of such an image intensifier tube is at first explained with reference to FIG. 1.

In a glass tube 2, there is provided a photocathode 3 on the inner wall of the transparent front plate thereof. In the vicinity of the photocathode 3 and within the tube 2, there are provided a focusing electrode 4 and then a microchannel plate 5. This microchannel plate 5 is one well known and has an input electrode 6 and an output electrode 7. On the inner surface of the transparent back plate of the glass tube 2 is provided a phosphor screen 8. The screen 8 and the above electrodes 4 and 5 are respectively connected with the exterior power source and adequate potentials are given thereto. An optical image formed on the photocathode 3 with a proper optical image forming means is converted into an electron image by the photocathode 3 and is multiplied by the microchannel plate 5, so as to form an intensified optical image on the phosphor screen 8.

In such a conventional image intensifier tube, many proposals have been made for controlling the brightness of the image intensity on the phosphor screen 8. For example, in U.S. Pat. Nos. 3,816,744, 4,195,222, etc., a bias voltage of the microchannel plate is controlled as an inverse function in order to adjust the tube gain. With such a structure the screen brightness may automatically be controlled.

However, even if the automatic brightness control may be made as mentioned above, when an excessive incident light (i.e. more than 1 lux) is entered, a good reproduction of image on the phosphor screen may not be obtained. In such a case, the contrast of the reproduced image will suddenly become deteriorated.

Further, if an excessive incident light continues to enter for a long time, the photocathode itself might break.

An object of this invention is therefore to provide a bias voltage control circuit of a microchannel plate which can also overcome the problems of the excessive incident light as mentioned above.

In order to solve the problems fully mentioned there are provided three operating regions of the image intensifier tube. In the first region where the amount of the incident light is the least among three, its multiplying rate of the microchannel plate is made to be kept as highly as possible. In the second region, the gain of the microchannel plate is made to be decreased in an inverse proportion to the increase of the incident light. Even in this second region, the brightness of the phosphor screen is made to increase gradually in proportion to the increase of the incident light. This method is taken because the image quality obtained on the phosphor screen is kept better in this case. An excessive light enters with which a good reproduction of image is not expected even if the automatic brightness control mentioned above is made and also with which the photocathode may be injured. In this third region, an oscillation is made to generate in the automatic brightness control feedback loop so as to generate blinking on the phosphor screen to warn the operator of the device. With this warning, the operator can control or restrict the amount of incident light which enters into the photocathode and convert it into the operation of the second region.

In other words, the microchannel plate voltage control circuit according to this invention includes a photocathode, a microchannel plate having input and output electrodes and a phosphor screen and further comprises a screen current rectifying circuit which rectifies a current of the phosphor screen and obtains a signal corresponding to the brightness of the phosphor screen; a differential amplifier which compares the signal obtained in the screen current rectifying circuit with a reference signal and generates a signal which increases proportionally to the phosphor screen current; a gas discharge tube; a transistor connected in series with the gas discharge tube with respect to a power source of the gas discharge tube and connected at its control input terminal with the signal of the differential amplifier, thereby an internal resistance of the transistor being controlled; a direct current power source applying a bias voltage to the microchannel plate; a photoconductor connected with the direct current power source in series with respect to the microchannel plate and photoelectrically coupled to the gas discharge tube; and a delaying element provided in a path for the signal from an output terminal of the phosphor screen current rectifying circuit and a control input terminal of the transistor; whereby enabling automatic brightness control so as to slightly increase the phosphor screen current in the automatic brightness control region of the brightness of the phosphor screen, and when an incident light into the photocathode is excessive, blinking the phosphor screen by a relaxation oscillation determined by the delaying element and the characteristic of the gas discharge tube.

The above object and the advantages of this invention will become more readily appreciated as the same becomes better understood by reference to the following detailed description when taken in conjunction with the accompanying drawings, wherein.

Figure 1:
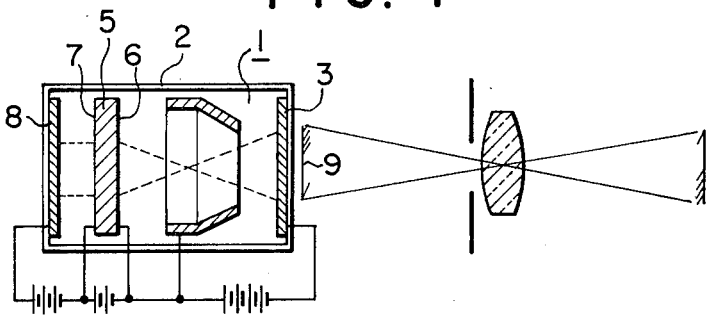
FIG. 1 is a schematic representation of an image intensifier tube incorporating a microchannel plate which is to be controlled by a circuit according to the present invention.
Figure 2:
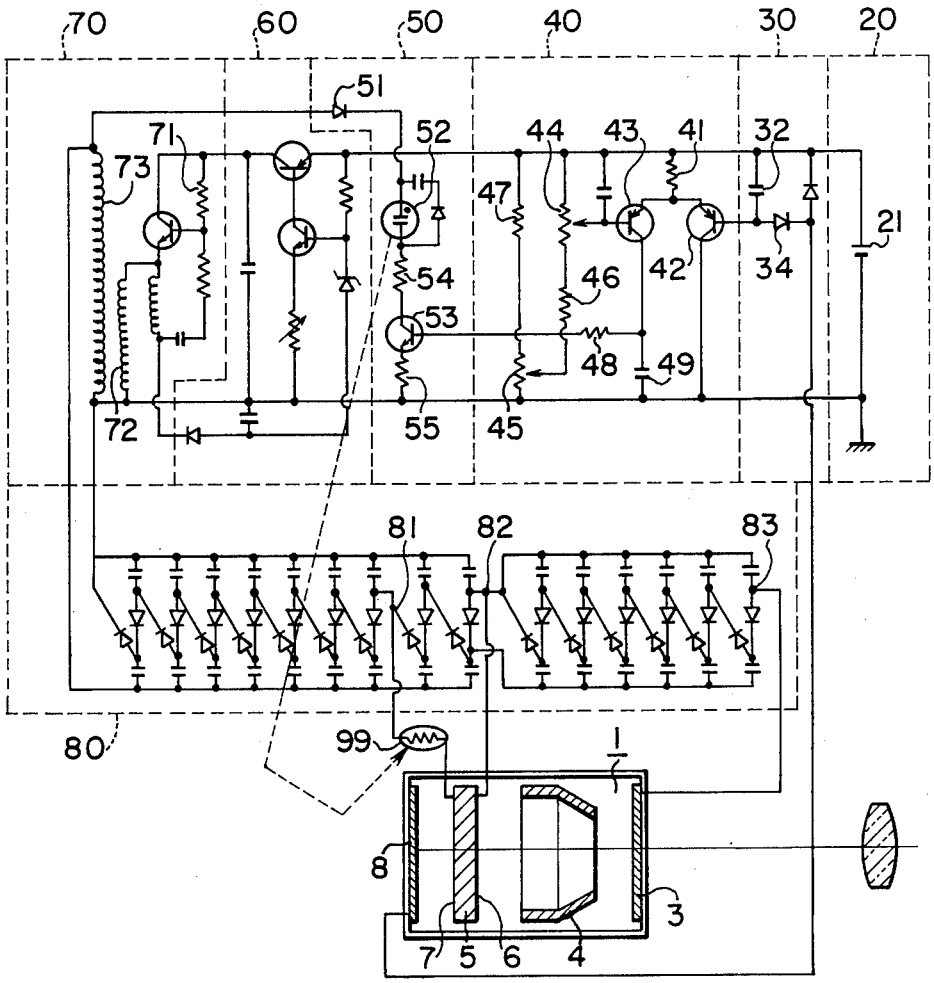
FIG. 2 is a circuit diagram of an embodiment of the circuit according to the present invention; and FIGS. *3a, 3b, 3c, 3d, 3e, 3f, 3g, 3h, 3i, 3j* are a graphical representations for explaining the operation of the circuit according to this invention.

Now detailed explanation on the circuit of this invention will be given with reference to FIG. 2. All power to this control circuit is applied from a cell 21 of a power block 20. The cell 21 is a mercury battery cell whose electromotive force is 2.7 volt. A negative electrode of the mercury battery cell 21 is connected with the base line of this control circuit. To a differential amplifier circuit 40 on which an explanation will be given later power is applied directly from this cell and to the other elements and the image intensifier tube, the boosted voltage of this voltage will be applied.

A block enclosed by a dashed line represented by the numeral 60 is a voltage stabilizer which itself is well known. The stabilizer 60 supplies a DC-AC converter enclosed by a dashed line 70 with a stabilized D.C. voltage. The DC-AC converter 70 has a transistor oscillator 71 and a step-up transformer 72. The DC-AC converter 70 boosts the output voltage of the stabilizer 60 (of less than 2.7 volt). To secondary windings 73 of the step-up transformer 72 there arises a voltage of 700 volt of 15 KHz. This voltage may be regulated by controlling the output voltage of the stabilizer 60.

A portion enclosed by a dashed line 80 is a well known voltage multiplying circuit. At points 81, 82 and 83 in the circuit 80 direct current voltages of 3.5 KV, 4.5 KV and 7.5 KV respectively appear with respect to the base line of the circuit. Therefore, between the photocathode 3 and the input electrode 6 of the microchannel plate 5 of the image intensifier tube 1 an accelerating voltage of 3 KV is applied. In this connection, the voltages of the focusing electrode 4 and the input electrode 7 of the microchannel plate 5 is the same in potential. To the input electrode 6 and the output electrode 7 of the microchannel plate 5 is applied a voltage of 1 KV between the points 81 and 82 through a CdS photoconductor 99, the point 81 being the output terminal of the bias source of the microchannel plate 5. As will be explained later, the phosphor screen 8 is maintained at a voltage nearly the same as the ground line of this circuit.

The photoconductor 99 is held in the same shielding box (not shown) with a neon tube 52 and optically coupled therewith, an explanation being given later on the neon tube 52. The resistance of the photoconductor 99 changes inverse proportionally to the brightness of the neon tube 52, while the bias voltage of the microchannel plate 5 changes proportionally to the brightness thereof. More particularly, the resistance of the photoconductor 99 becomes 2 MΩ when the brightness of the neon tube 52 is at its maximum and 500 MΩ at its minimum brightness. When the neon tube 52 is extinguished, its internal resistance becomes 2000 MΩ. Therefore, the maximum brightness of the neon tube 52 at the microchannel plate 5 is:

$$1\ \text{KV} \times \frac{500}{500 + 2} \approx 1\ \text{KV},$$

and the minimum brightness is:

$$1\ \text{KV} \times \frac{500}{500 + 500} \approx 0.5\ \text{KV}.$$

The multiplying rate of the microchannel plate 5 is 1, when the voltage between the input and output terminals is 0.5 KV, and $10^4$ when it is 1 KV. When the neon tube 52 is not ignited, and $$1\ \text{KV} \times \frac{500}{500 + 2000} \approx 0.2\ \text{KV},$$

the multiplying rate is almost 0.

A rectifier circuit block 30 is a circuit which rectifies a phosphor screen current of the image intensifier tube. In this case the phosphor screen current represents the brightness of the phosphor screen. The block 30 has a diode 31 and a capacitor 32 whose capacitance is in this embodiment 0.1 μF. The capacitor 32 stores and electric charge corresponding to the brightness of the phosphor screen 8.

A differential amplifier block 40 has two PNP transistors 42 and 43 and the base electrode of the transistor 42 is connected with the connecting point of the capacitor 32 and the diode 31 in the above-mentioned rectifying circuit block 30. Emitter electrodes of the transistors 42, 43 are connected with the positive electrode of the cell 21 through a resistor 41. The collector electrode of the transistor 42 is connected with the base line, while the collector electrode of the transistor 43 is connected with the base line through a capacitor 49. A variable resistor 44 and resistors 45, 46 and 47 form a voltage divider and supply a reference voltage to the base electrode of the transistor 43. The reference voltage is set to determine the level between second and third regions shown in FIG. 3. The collector current of the transistor 43, which corresponds to the difference of the voltage of the capacitor 32 determined by the phosphor screen current and the reference voltage is applied to the base of a transistor 53 of the next stage through a resistor 48.

As an example, values of the respective elements of this block 40 may be as follows:

| | |
|---|---|
| 41 | 47 KΩ |
| 44 | 20 KΩ |
| 45 | 2 KΩ |
| 46 | 3.9 KΩ |
| 47 | 8.2 KΩ. |

The resistor 48 and a capacitor 49 form the output delaying circuit of the differential amplifier 40. The values of the resistor 48 and the capacitor 49 are 100 KΩ and 2.2 μF, respectively.

A neon tube brightness control circuit block encircled by a dashed line 50 is to control the brightness of the neon tube 52 with which the photoconductor 99 is coupled. In the block 50, the anode of a diode 51 is connected with the secondary winding of the step-up transformer of the above-mentioned DC-AC converter, while its cathode is connected with one end of the neon tube 52. The other end of the neon tube 52 is connected with one end of a resistor 54 whose resistance is 5 MΩ. Further, the other end of the resistor 54 is connected with a collector electrode of the transistor 53 which is of the high voltage withstanding type NPN transistor. The emitter electrode of the transistor 53 is further connected with the ground line of the circuit.

The internal resistance of the transistor 53 is controlled by the output current of the differential amplifier circuit 40. Therefore when the output current is large, the internal resistance becomes reduced and when it is small, the internal resistance becomes larger.

As is well known the firing voltage and the extinguishing voltage of the gas discharge tube, such as a neon tube, are different from each other. In the case of the neon tube 52, when the voltage between the both electrodes reaches 82 V, it starts firing and can maintain its discharge even if the voltage decreases to 80 V. The minimum current for maintaining the discharge thereof is approximately 1 μA.

The present invention is to utilize this difference of voltages, and a blinking for warning, on which an explanation will be given later, is possible by the existence of this voltage difference and the delaying elements included in the circuit. In the circuit, there are included many delaying elements, and the capacitors 32, 49 are the typical elements in the circuit. The delay in response to the photoconductor 99 becomes a cause of delay, though such is minor in extent.

Figure 3:
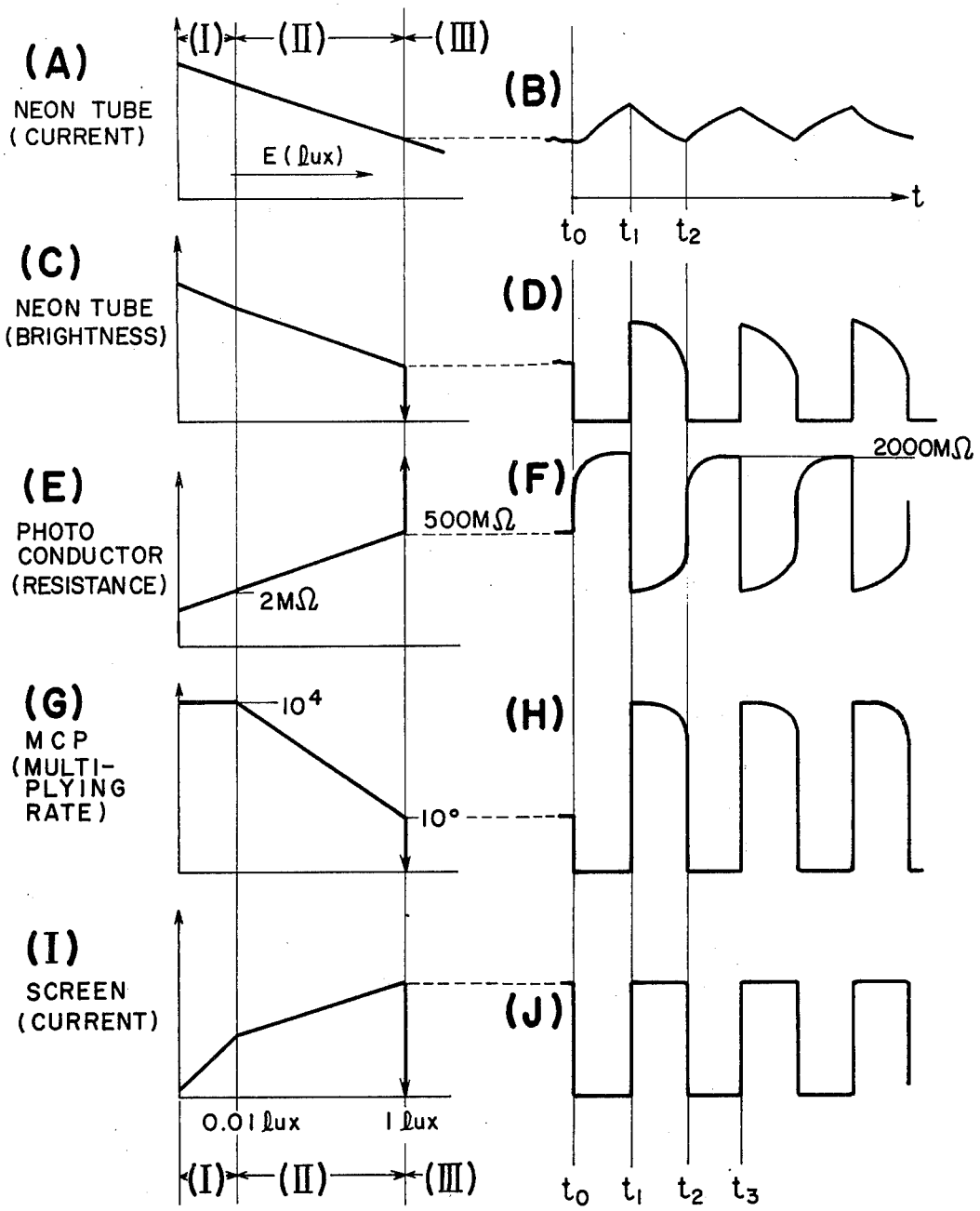

The operation of the above circuit is now explained with reference to FIG. 3. The operational region of the above mentioned embodiment may be divided into three regions according to the luminance of an image entered into the photocathode 3. The first region, indicated in FIG. 3 as I, is for less than 0.01 lux, the second region, II, between 0.01 and 1 lux and the third region, III, is for the luminance exceeding 1 lux. The above first region I represents the largest gain of the image intensifier tube and the second region II is for the automatic brightness control. In the third region III, since the incident light is excessive, the phosphor screen 8 blinks to warn this. In FIG. 3, marks A, C, E, G and I represent graphs showing respectively the neon tube current, the neon tube brightness, the resistance of the photoconductor, the multiplying rate of the microchannel plate and the screen current. In these graphs the abscissas represent the luminance of the above-mentioned incident image. The changes of the values in the graphs only show the tendency of changes for easy understanding and not strictly correspond to the actual operation. The graphs B, D, F, H and J in FIG. 3 show the changes in the time element of the graphs A, C, E, G and I, respectively and in these graphs the abscissas represent time, and the time when it entered into the third region III from the second region II is indicated as $t_o$.

In the first region I, the luminance of the incident light into the photocathode 3 is less than 0.01 lux and the brightness of the phosphor screen 8 is extremely low. Load to the capacitor 32 of the circuit block 30 is small. Therefore, sufficient current is supplied to the transistor 53 of the neon tube brightness control circuit 50 from the transistor 43 of the differential amplifier circuit block 40. Further, the resistance of the photoconductor 99 is sufficiently low (less than 2 MΩ), and therefore a bias voltage of nearly 1 KV is applied to the microchannel plate 5, which shows the largest multiplying rate $10^4$.

In the first region I, any substantial automatic brightness control is not performed and therefore the brightness of the phosphor screen 8 increases corresponding to the increase of the luminance of the incident light, which is well shown in the region I of FIG. 3.

Now an explanation is being given on the second region II. According to the increase of the phosphor screen current, the output current of the differential amplifier 40 decreases, thereby further decreasing the internal resistance of the transistor 53 of the neon tube brightness control circuit 50. The neon tube current gradually decreases and the resistance of the photoconductor 99 also increases gradually until it exceeds 2 MΩ. As the result, the bias voltage of the microchannel plate 5 gradually decreases from 1 KV, and the multiplying rate decreases as shown in G of FIG. 3.

As mentioned above, according to the increase of the incident luminance the gain of the tube decreases. However, the screen current is certainly but only in minor extent increases according to the increase of the incident luminance. In the present invention it is not an object to make the screen current constant but to raise the screen current even in a minor extent according to the increase of the incident luminance, and to obtain a good reproduction of image. If a feedback is performed as to make the screen current constant, the reproduced image quality of the larger incident luminance even in the second region II is deteriorated.

Now an explanation is being given on the operation in the third region III with reference mainly to FIG. 3. When the luminance of the incident light to the photocathode exceeds, for example, 1 lux, the phosphor screen 8 of the image intensifier tube starts blinking.

By the increase of the incident luminance, the phosphor screen current becomes large and the output current of the differential amplifier 40 decreases. As the result, the internal resistance of the transistor 53 of the neon tube control circuit further becomes larger, and when the voltage between the terminals of the neon tube 52 reaches 80 V, the discharge thereof may not be maintained any more. When the neon tube 52 now extinguishes, the resistance of the photoconductor 99 which has been around 500 MΩ becomes rising toward 2000 MΩ. As the result, the bias voltage of the microchannel plate 5 decreases and its multiplying rate suddenly decreases as shown in G of FIG. 3. Therefore, even if there is an ample incident light, the brightness of the phosphor screen 8 rapidly decreases, suddenly decreasing the phosphor screen current as shown in FIG. 3, I.

As the result, the output of the differential amplifier 40 shows an increase, and tends to decrease the internal resistance of the transistor 53 and to increase the neon tube current. However, since there is included in the circuit the delaying elements of the capacitors 32, 49, etc., the neon tube current does not rise rapidly from the time $t_o$ but rises gradually as shown in FIG. 3, B. The voltage between the terminals of the neon tube 52 reaches 82 V at the time of $t_1$ and ignites. The brightness of the neon tube 52 at this time of firing is larger than that of the time of extinguish and therefore the resistance of the photoconductor 99 is decreased rapidly. As the result thereof the multiplying rate of the microchannel plate 5 rises suddenly and the brightness of the phosphor screen rises. The screen current also increases. However, since there is a delay in the automatic brightness control loop, the neon tube current does not increase rapidly but decreases with some delay as shown between $t_1$ and $t_2$ of B, FIG. 3. At the time of $t_2$, the neon tube extinguishes. As the result, the resistance of the photoconductor 99 increases, while the brightness of the screen 8 decreases. Also, the screen continues blinking. In this embodiment, the period of the screen blinking is for 0.5 second. The operator can notice the excessive incident light which enters into the photocathode 3 by this warning and can restrict the incident light with an iris or the like to change the operation region of the image intensifier tube to the second region II.

As is fully explained in detail as above, according to the circuit of the present invention a good automatic brightness control may be made in the second region II without the sacrifices of the image quality, and warning is performed in the third region III, so that the operator of the device can control the luminance of the incident light and change the operation of the image intensifier tube into the operation of the second region II.

Therefore, the operation always in the most convenient condition may be possible. Also, any injury of the image intensifier tube by the excessive luminance of the incident light may be avoided.

A detailed explanation has been made with reference to an embodiment, but the circuit of this invention may be modified in many ways within the scope of the attached claims. It is therefore to be noted that the scope of the present invention is limited only by the scope of these claims.

What I claim is:

1. An automatic brightness control and warning circuit for an image intensifier tube which includes a photocathode, a microchannel plate having input and output electrodes and a phosphor screen, comprising:

(a) a screen current rectifying circuit which rectifies a current of the phosphor screen and obtains a signal corresponding to the brightness of the phosphor screen;

(b) a differential amplifier which compares the signal obtained in the screen current rectifying circuit with a reference signal and generates a signal which increases proportionally to the phosphor screen current;

(c) a gas discharge tube;

(d) a transistor connected in series with the gas discharge tube with respect to a power source of the gas discharge tube and connected at its control input terminal with the signal of the differential amplifier; thereby an internal resistance of the transistor being controlled;

(e) a direct current power source applying a bias voltage to the microchannel plate;

(f) a photoconductor connected with the direct current power source in series with respect to the microchannel plate and photoelectrically coupled to the gas discharge tube; and (g) a delaying element provided in a path for the signal from an output terminal of the phosphor screen current rectifying circuit and a control input terminal of the transistor; whereby enabling automatic brightness control so as to slightly increase the phosphor screen current in the automatic brightness control region of the brightness of the phosphor screen, and when an incident light into the photocathode is excessive, blinking the phosphor screen by a relaxation oscillation determined by the delaying element and the characteristic of the gas discharge tube.

2. An automatic brightness control and warning circuit according to claim 1, wherein the gas discharge tube and the photoconductor are kept in a sealed box and the photoconductor is to respond solely to a light flux of the gas discharge tube.

3. An automatic brightness control and warning circuit according to claim 1, wherein the microchannel plate has a saturation region in which the multiplying rate thereof does not increase even when the bias voltage increases; and when the luminance of the incident light to the phosphor screen is low, it keeps its largest and constant multiplying rate, the brightness of the phosphor screen being in proportion to the luminance of the incident light.

4. An automatic brightness control and warning circuit according to claim 1, wherein the gas discharge tube is a neon tube which fires when its voltage between the terminals reaches 82 V and extinguishes when the voltage drops to 80 V.

5. An automatic brightness control and warning circuit according to claim 1, wherein the photoconductor is a CdS photoconductor.

6. An automatic brightness control and warning circuit according to claim 1, wherein the delaying element is a capacitor included in the screen current rectifying circuit and another capacitor is connected with an output terminal of the differential amplifier.

* * * * *